US007688167B2

(12) United States Patent
Paranjpye et al.

(10) Patent No.: US 7,688,167 B2
(45) Date of Patent: Mar. 30, 2010

(54) CONTACT ELECTRODE FOR MICRODEVICES AND ETCH METHOD OF MANUFACTURE

(75) Inventors: Alok Paranjpye, Santa Barbara, CA (US); Douglas L. Thompson, Santa Barbara, CA (US)

(73) Assignee: Innovative Micro Technology, Goleta, CA (US)

( * ) Notice: Subject to any disclaimer, the term of this patent is extended or adjusted under 35 U.S.C. 154(b) by 646 days.

(21) Appl. No.: 11/546,288

(22) Filed: Oct. 12, 2006

(65) Prior Publication Data

US 2008/0087530 A1 Apr. 17, 2008

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 3,728,176 A 4/1973 Osborne et al.
6,057,520 A * 5/2000 Goodwin-Johansson .... 200/181
6,458,687 B1 10/2002 Eldridge
6,876,482 B2 4/2005 DeReus
7,002,441 B2 * 2/2006 Pillans et al. ..... 335/78
7,170,216 B2 * 1/2007 Sanpei et al. ..... 310/331
7,218,191 B2 * 5/2007 Bozler et al. ..... 333/262
7,528,691 B2 * 5/2009 Wallis et al. ..... 335/78
2004/0124497 A1 7/2004 Rottenberg et al.
2005/0168306 A1 8/2005 Cohn et al.

FOREIGN PATENT DOCUMENTS

JP 2007304512 A * 11/2007

OTHER PUBLICATIONS

"A High-Current Electrothermal Bistable MEMS Relay" Qui et al., Micro Electro Mechanical Systems, 2003. MEMS-03 Kyoto. IEEE The Siteenth Annual International Conference on MEMS, Jan. 19-23, 2003. pp. 64-67.

* cited by examiner

*Primary Examiner*—Elvin G Enad
*Assistant Examiner*—Bernard Rojas
(74) *Attorney, Agent, or Firm*—Jaquelin K. Spong

(57) ABSTRACT

A contact electrode for a device is made using an etching process to etch the surface of the contact electrode to form a corrugated contact surface wherein the outer edges of at least one grain is recessed from the outer edges of adjacent grains and is recessed by at least about 0.05 μm from the contact plane. By having such a corrugated surface, the contact electrode is likely to contact another conductor with at least one pure metal grain. This etching treatment reduces contact resistance and contact resistance variability throughout many cycles of use of the contact electrode.

20 Claims, 10 Drawing Sheets

CONTACT ELECTRODE FOR MICRODEVICES AND ETCH METHOD OF MANUFACTURE

CROSS-REFERENCE TO RELATED APPLICATIONS

Not applicable.

STATEMENT REGARDING FEDERALLY SPONSORED RESEARCH

Not applicable.

STATEMENT REGARDING MICROFICHE APPENDIX

Not applicable.

BACKGROUND

This invention relates to contact electrodes for microdevices, and their method of manufacture.

Microelectromechanical systems (MEMS) are very small moveable structures made on a substrate using lithographic processing techniques, such as those used to manufacture semiconductor devices. MEMS devices may be moveable actuators, valves, pistons, or switches, for example, with characteristic dimensions of a few microns to hundreds of microns. A moveable MEMS switch, for example, may be used to connect one or more input terminals to one or more output terminals, all microfabricated on a substrate. The actuation means for the moveable switch may be thermal, piezoelectric, electrostatic, or magnetic, for example.

The MEMS switch may, for example, include a set of gold electrodes formed on the end of a cantilevered beam, which may make electrical contact with another set of conductive electrodes when the beam is actuated by, for example, thermal or electrostatic displacement. Because of the small size of the device, the forces involved in these actuation mechanisms may not be substantial. In addition, because of the small contact area of the electrodes, the electrical contact may be dominated by a very small portion of the electrode surface, for example one or two gold grains. Any event which causes a change to this portion of the electrode surface, such as deformation or contamination, can lead to a large change in the contact resistance between the electrodes. A variable, and particularly an increasing contact resistance can cause a substantial reliability issue with the switch, especially when the contacts are transmitting an electrical signal which is diminished by increased contact resistance, or a current-carrying switch which generates more heat when the contact resistance rises. For at least these reasons, in general, a low contact resistance is a figure of merit for both MEMS and non-MEMS electrical switches.

SUMMARY

Systems and methods presented here are used to etch the contacts in a microdevice, thereby changing the morphology of the contact surface to a rough, corrugated topography, wherein the outer edge of one grain is recessed from the outer edges of adjacent grains. This morphology results from the etching action, wherein the etch rate of the different grains depends on the crystallographic orientation of the grains, leaving the corrugated surface. Such a morphology helps to ensure that the electrical connection between two contacts is dominated by a small number of essentially pure metal grains. Furthermore, mating two similarly etched contact surfaces may result in the enmeshing of the corrugation features, thereby increasing the overall contact area and reducing the contact resistance. By using this method, a substantial improvement in the magnitude and repeatability of the contact resistance between a pair of contacts is obtained. This morphology may be obtained by etching the microdevice for about 60 seconds in, for example, a liquid etchant designed to etch the material of the contact while leaving the other materials in tact.

The systems and method are described with respect to a first exemplary embodiment, that of a gold contact formed at the distal end of a cantilevered beam. Because of the design of the switch, the contact surface of the contact electrode may be oriented perpendicularly with respect to the substrate surface. The cantilevered beam is actuated by an adjacent drive loop, which is a conductive circuit that expands on application of a drive current to the loop. The drive loop is tethered to the cantilevered beam with a dielectric tether, such that the current passes only through the drive loop, and not through the cantilevered beam. Upon heating the drive loop with the current, the expansion of the drive loop displaces the cantilevered beam in a predetermined direction, generally along a plane parallel to the surface of the substrate. An electrical switch includes a pair of such cantilevered beams, each with a conducting gold contact at the distal end of each cantilevered beam. By actuating the pair of cantilevered beams in a particular sequence, the pair of contacts disposed on the ends of the cantilevered beams make contact, thereby closing the electrical switch.

However, because the forces involved in this thermal switch are modest, they may not be sufficient to deform to each other and conform, so that contact may be made over a large area. Therefore, the contact resistance may be dominated by a small surface area, because the forces are not sufficient to appreciably deform the contact surfaces. Any contamination or irregularity of this surface may make the contact resistance between the contacts higher and more variable.

The contact resistance of the gold contact electrodes on the cantilevered beams is reduced and made less variable by applying the etching treatment. Although the systems and methods are described with respect to this switch embodiment, it should be understood that the systems and methods may be applicable to any device which would benefit from reduced contact resistance, and improved reliability of the contact resistance.

According to the systems and methods disclosed here, after the completion of the fabrication steps for the contact electrodes, the cantilevered beam and the drive loop, the device is immersed in a liquid etchant for about 1 minute, which removes less than about 0.2 μm of material from the electrodes. Thus, the dimensions of the contact electrodes, which are typically about 5 μm in length, are not changed appreciably by the etching. The etching appears to etch the gold grains at different rates, depending on their crystallographic orientation, leaving a surface of exposed metal grains of different crystallographic orientation, with a surface roughness having a wavelength of about 0.25 μm and an amplitude of about 0.05 μm. The etching may also remove contaminants that build up on the contact electrodes during handling or processing.

When the switch is closed, the contact electrodes touch each other with a surface of pure gold grains, because the interstitial areas and some of the grains are recessed more than others from the contact surface. Thus, the contact resistance of the switch is low and stable.

The contact plane of the contact surface may be defined by the outer edges of the metal grains in the contact surface. For contact surfaces made using the etching treatment described herein, the outer edge of at least one grain in the contact surface is recessed with respect to the outer edges of adjacent grains, and may be recessed by at least about 0.05 μm from the contact plane.

In another exemplary embodiment, the etching technique is applied to multilayer film electrodes deposited at the end of a cantilevered beam formed on a first, upper substrate. The cantilevered beam is actuated by electrostatic interaction with a drive plate on a second, lower substrate. The etching of the multilayer film electrodes may be performed on the first, upper substrate and the second, lower substrate, before the first, upper substrate is bonded to the second, lower substrate to form the electrostatic cantilevered switch.

These and other features and advantages are described in, or are apparent from, the following detailed description.

BRIEF DESCRIPTION OF THE DRAWINGS

Various exemplary details are described with reference to the accompanying drawings, which however, should not be taken to limit the invention to the specific embodiments shown but are for explanation and understanding only.

DETAILED DESCRIPTION

Although the devices and methods described herein are described with respect to particular types of MEMS thermal switches, it should be understood that these embodiments are exemplary only, and that the systems and methods described here may be applied to any of a number of MEMS and non-MEMS devices, for which lower predictable electrode contact resistance is an important design parameter.

Figure 1:
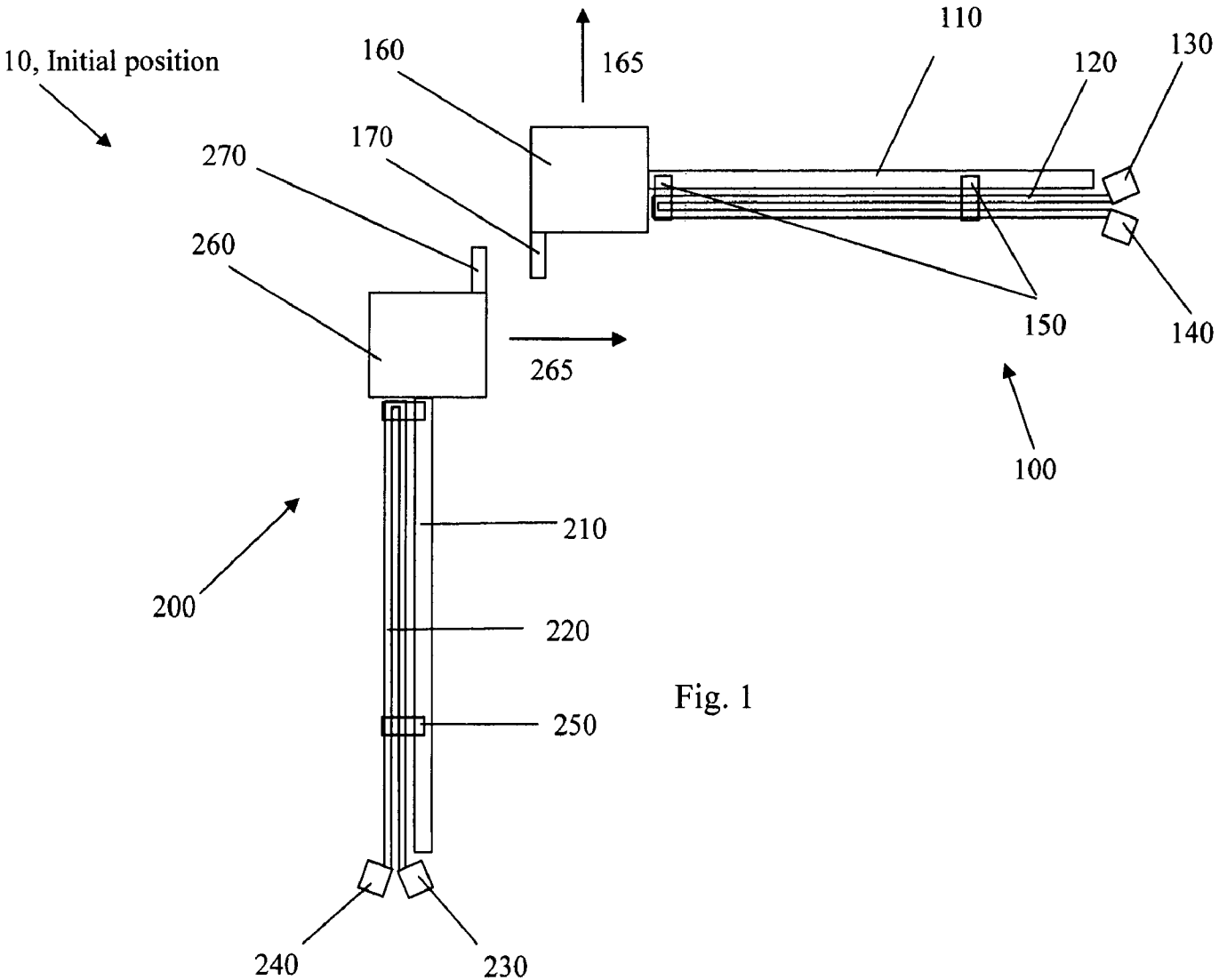
FIG. 1 is a schematic view of a first exemplary MEMS switch platform which may be suitable for the application of this invention.

FIG. 1 shows an example of a MEMS thermal switch 10, which may be suitable for the application of the etching systems and methods described here. The MEMS thermal switch 10 may be actuated by the application of a current through a cantilevered conductive circuit, which is adjacent and tethered to another cantilevered beam.

The thermal switch 10 may include two cantilevers, 100 and 200. Each cantilever 100 and 200 contains a passive beam 110 and 210, respectively. A conductive circuit 120 and 220 may be coupled to each passive beam 110 and 210, respectively, by a plurality of dielectric tethers 150 and 250. When a voltage is applied between terminals 130 and 140, a current is driven through conductive circuit 120. The Joule heating generated by the current causes the circuit 120 to expand relative to the unheated passive beam 110. Since the circuit is coupled to the passive beam 110 by the dielectric tether 150, the expanding conductive circuit drives the passive beam in the upward direction 165.

Applying a voltage between terminals 230 and 240 causes heat to be generated in circuit 220, which drives passive beam 210 in the direction 265 shown in FIG. 1. Therefore, one beam 100 moves in direction 165 and the other beam 200 moves in direction 265. These movements may be used to open and close a set of contacts located on contact electrodes 170 and 270, each in turn located on tip members 160 and 260, respectively. The sequence of movement of contact electrodes 170 and 270 on tip members 160 and 260 of switch 19 is shown in FIGS. 2*a*-2*d*, to close and open the electrical switch 10.

Figure 2A:
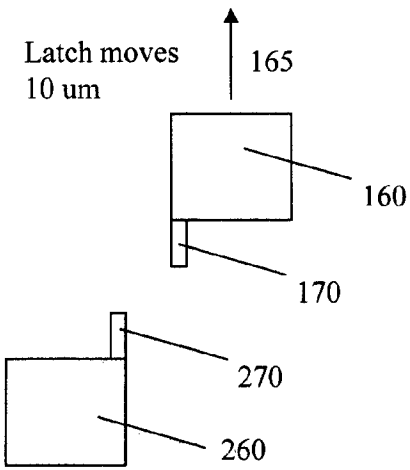
FIGS. 2*a*-2*d* are diagrams illustrating the sequence of movements required to close the switch illustrated in FIG. 1.
Figure 2B:
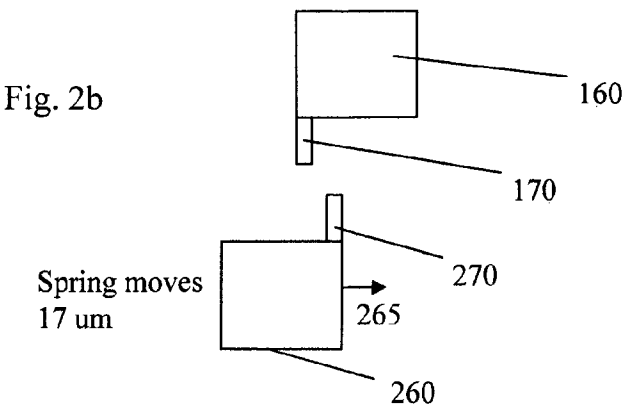
Figure 2C:
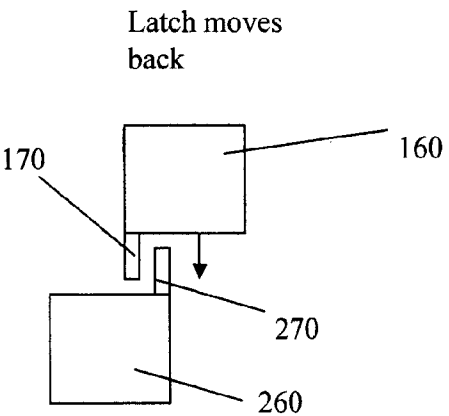
Figure 2D:
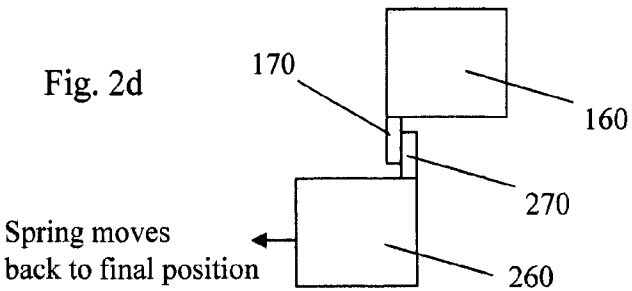

To begin the closing sequence, in FIG. 2*a*, tip member 160 and contact electrode 170 are moved in the direction 165 by the application of a voltage between terminals 130 and 140. In FIG. 2*b*, tip member 260 and contact electrode 270 are moved in the direction 265 by application of a voltage between terminals 230 and 240. In FIG. 2*c*, tip member 160 and contact electrode 170 are brought back to their initial position by removing the voltage between terminals 130 and 140. This stops current from flowing and cools the cantilever 100 and it returns to its original position. In FIG. 2*d*, tip member 260 and contact electrode 270 are brought back to nearly their original position by removing the voltage between terminals 230 and 240. However, in this position, tip member 160 and contact electrode 170 prevent tip member 260 and contact electrode 270 from moving completely back to their original positions, because of the mechanical interference between contact electrodes 170 and 270. In this position, contact between the faces of contact electrodes 170 and 270 provides an electrical connection between cantilevers 100 and 200, such that in FIG. 2*d*, the electrical switch is closed. Opening the electrical switch is accomplished by reversing the movements in the steps shown in FIGS. 2*a*-2*d*.

MEMS switches such as that shown in FIG. 1 may not generate a large amount of force. In particular, it should be noted that the contact surfaces of the contact electrodes in the device of FIG. 1 are oriented perpendicular to the substrate, surfaces, so that the contact force is purely the lateral force exerted by the cantilevered thermal actuators 100 and 200. For the switch shown in FIG. 1, the force of one contact electrode 170 on the other contact electrode 270 may be between about 10 microNewtons (μN) and 1 milliNewton (mN), depending on the details of the design. Because of the low contact force and the small area over which this force operates, a small contact area on contact electrodes 170 and 270 may be relied upon to provide electrical conductivity between cantilevers 100 and 200. Any variability in the mechanical or electrical attributes of the contact area can alter the contact resistance between cantilever 100 and cantilever 200. Variability can also arise from changes in the ambient temperature, or from the presence or removal of contaminants or impurities on the contact electrodes 170 and 270, or from erosion of the contact electrode topography from repeated use. Furthermore, any treatments to the contact surface must be applied laterally, as the contact surfaces are oriented perpendicularly to the substrate surface.

Figure 3:
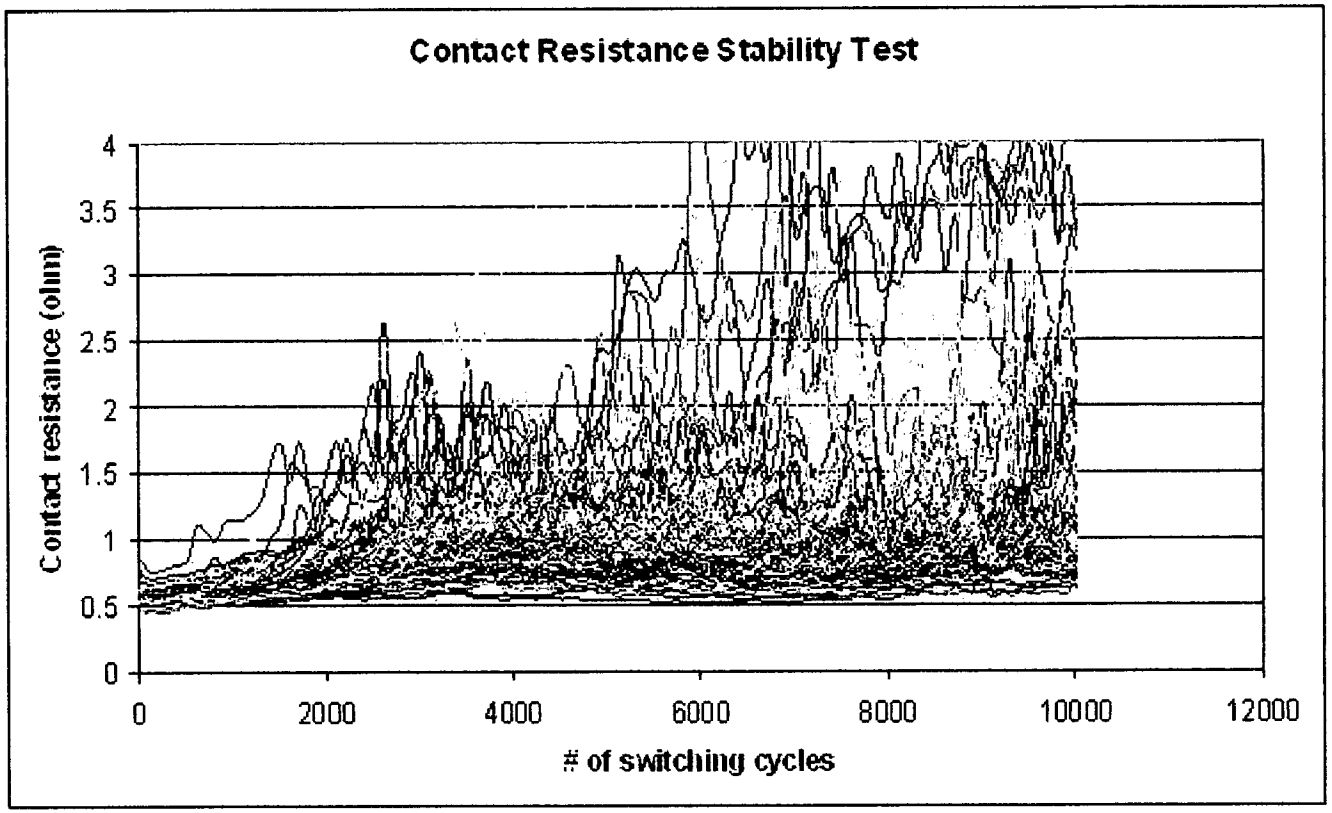
FIG. 3 is a plot of the contact resistance versus the number of switching cycles for the contact electrodes according to the prior art.

The variability in contact resistance may be manifested by sudden and unrepeatable changes in the contact resistance between contact electrode 170 and contact electrode 270. FIG. 3 is a plot of the contact resistance between contact electrode 170 and contact electrode 270 as a function of the number of open/closing cycles. The data plotted in FIG. 3 show the contact resistance for a population of MEMS switches such as that shown in FIG. 1. As can be seen in the plot, the contact resistance is variable between the different switches in the population, but even for a particular switch, the contact resistance appears to rise after about 1000 open/close cycles, from its original value of less than an ohm, to values between 1.0 and 2.5 ohms at between about 2000 and 3000 cycles. Beyond 3000 cycles, the contact resistance rises dramatically to 4.0 ohms or more, for a substantial population of the switches. This type of behavior may cause field failures of the device, and the rise in contact resistance may be exacerbated by increased operating temperatures, which may make the electrode material softer and more malleable. By applying the etch technique described here, much of this increase and variability in contact resistance can be reduced or eliminated.

Figure 4:
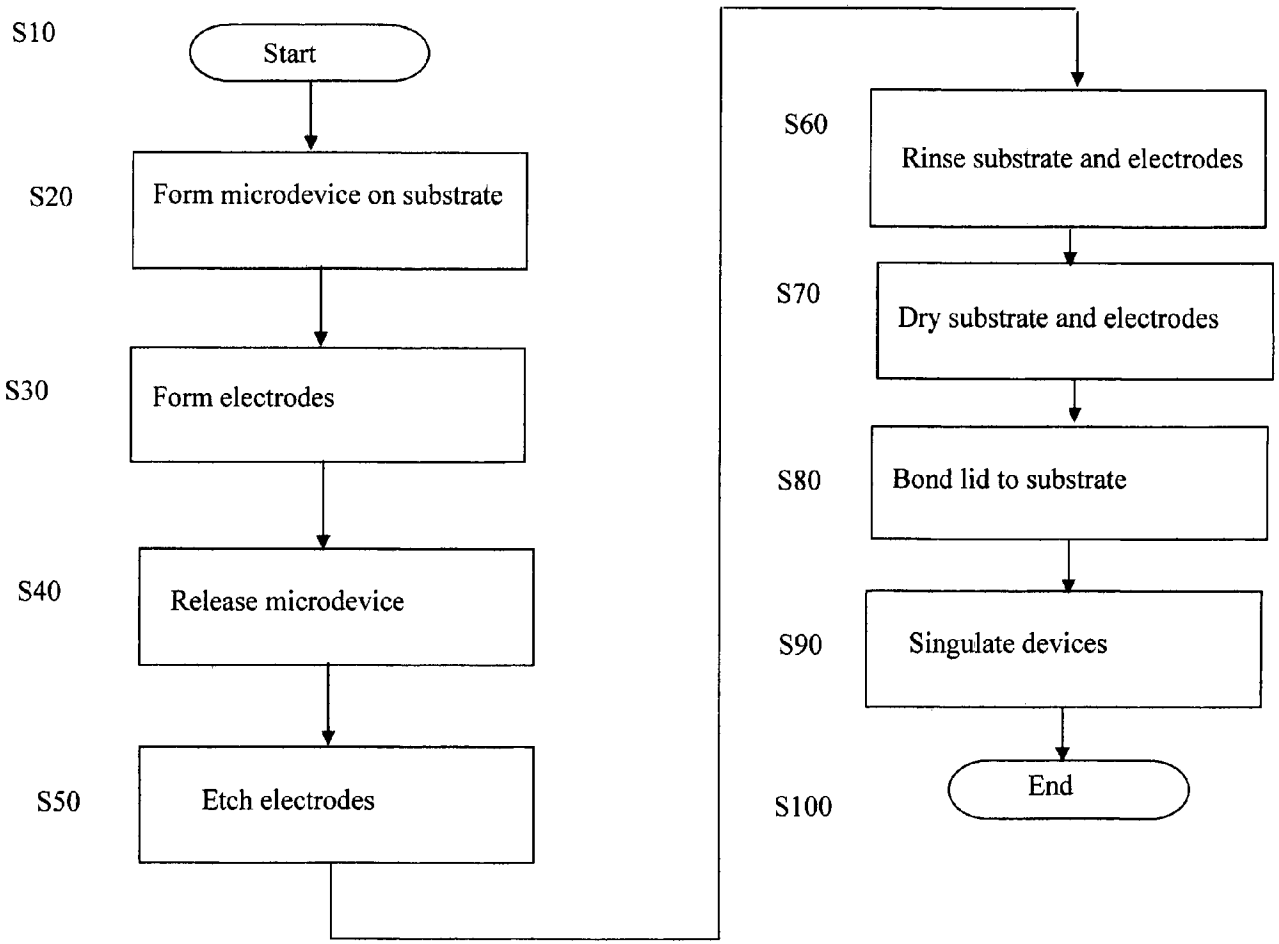
FIG. 4 is a flowchart of an exemplary embodiment for the etching method for the contact electrodes.
Figure 5:
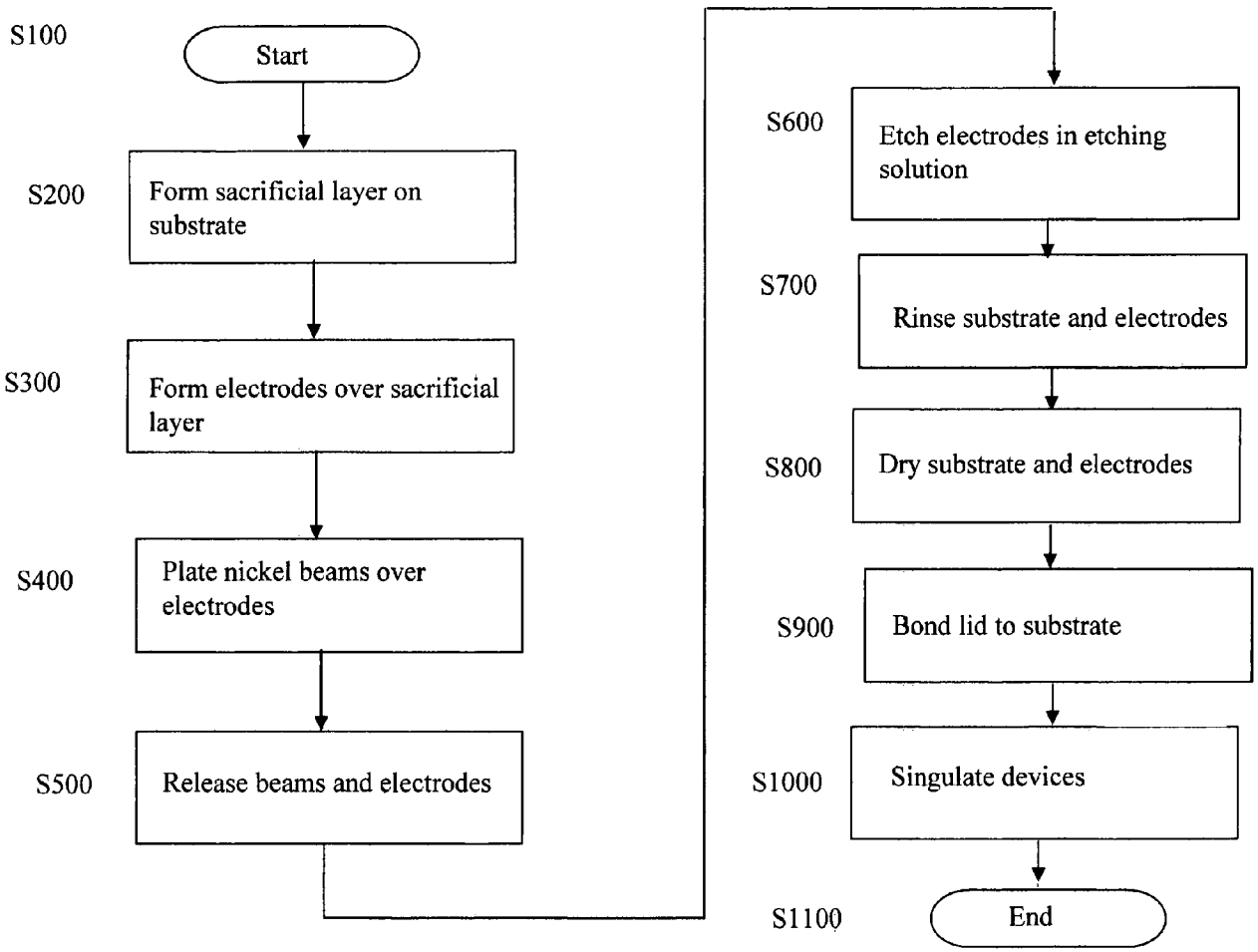
FIG. 5 is a flowchart of a second exemplary embodiment for the etching method for the contact electrodes.

FIGS. 4 and 5 are a flowcharts illustrating exemplary embodiments of a method for etching the electrode materials of a microdevice to reduce contact resistance and variability. FIG. 4 is a general embodiment of the method whereas FIG. 5 is an embodiment of the method as applied to the switch of FIG. 1.

As shown in FIG. 4, the method begins in step S10 and proceeds to step S20, where the microdevice is formed on a substrate. In step S30, the electrodes of the microdevice are formed. In step S40, the device is released, that is, any restraining structures are removed so that the device is free to move. In step S50, the device is etched in an etching solution which etches the electrode material. In step S60, the device is rinsed, which stops the etching action of the etchant on the electrode materials. In step S70, the device is dried. In step S80, a lid is bonded to the substrate which will protect the moving parts in a protective cavity. The wafer is singulated in step S90, to separate the devices from each other. The process ends in step S100.

It should be understood that not all of the steeps illustrated in FIG. 4 may be required, and that the steps illustrated in FIG. 4 need not be carried out in the order shown. For example, the electrodes may be formed in step S30 before the device is formed in step S20, and the etching of the electrodes in step S50 may be carried out before the device is released in step S40. Furthermore, if the microdevice is not a moveable MEMS device, steps S40 and S80 may be omitted.

FIG. 5 illustrates the method outlined in FIG. 4 as applied to the switch shown in FIG. 1. For this switch, the gold electrodes are formed before the cantilevered beams. Details as to the fabrication of these structures may be found in co-pending U.S. application Ser. No. 11/263,912 and U.S. application Ser. No. 11/334,438, hereby incorporated by reference in their entireties. However, it should be understood that this switch is only one exemplary embodiment, and that the systems and methods described here may be applied to any device having electrodes, and particularly for moving devices or MEMS having electrodes.

The process begins in step S100 and proceeds to step S200, wherein a sacrificial layer is formed over the surface of a substrate. In one exemplary embodiment, the sacrificial layer is copper, which may be electroplated on the surface of the substrate and may be subsequently conveniently removed with an isotropic etch using an ammonia-based Cu etchant. In step S300, gold electrodes are formed over the sacrificial layer. This gold may form the tip members 160 and 260 and contact electrodes 170 and 270. Gold may be chosen for this component because it may have lower contact resistance than the material chosen for the cantilevered beams 110 and 210, which must have good mechanical properties for bending in response to the expansion of conductive circuits 120 and 220.

In step S400, nickel or nickel alloy cantilevered beams are deposited over the gold electrodes and the sacrificial layer. This plating may be preceded by the deposition of a plating seed layer, for example, chromium (Cr) and gold (Au), deposited by chemical vapor deposition (CVD) or sputter deposition to a thickness of 100-200 nm. Photoresist may then be deposited over the seed layer and patterned with the outline of the desired cantilevered beams. The photoresist then serves as a stencil for the plating of the nickel or nickel alloy. Nickel or a nickel alloy is chosen for the cantilevered beam because of its suitable stiffness and resistance to plastic deformation. The nickel or nickel alloy may be plated through the photoresist stencil. In addition, deposition processes other than plating may be used to form the cantilevered beams.

In step S500, the cantilevered beams and gold electrodes are released from the substrate by, for example, etching away the sacrificial layer. In step S600, the gold electrodes are etched in a gold etching solution. In step S700, the etching solution is rinsed from the device, which stops the etching of the gold electrode. In step S800, the device is dried and the substrate is bonded to a lid in step S900 to protect the switch from handling damage, for example. Further details for the bonding of a device wafer to a lid wafer may be found in U.S. patent application Ser. No. 11/211,622, which is incorporated by reference herein in its entirety. The substrate may be singulated in step S1000. The process ends in step S1100.

To perform step S600, etching the electrode material, a liquid etchant may be chosen which preferentially etches the gold contact electrode while leaving the other materials, such as the nickel beams, unetched. One exemplary embodiment of step S600 is immersing the wafer in a cyanide or iodine-based gold etchant, such as GE-8111 manufactured by Transene Company, Incorporated, of Danvers, Mass. This etching solution is based on potassium iodide and iodine ($KI/I_2$) chemistry and does not contain cyanide. GE-8111 is acidic with a pH of about 2.5. The pH may be increased by diluting the GE-8111 with an equal part of potassium hydroxide (KOH), and about a sixth part water. Adjusting the pH of the etchant may render it selective to the gold of the electrodes, rather than indiscriminately etching the copper and nickel. In this embodiment, the pH of the etching solution is adjusted to be between about 7.3 and 7.5, by the addition of potassium hydroxide and water to the solution. The etching may be performed at room temperature in a well-ventilated area.

The etch rate for GE-8111 at room temperature is about 3 nm/sec. The substrate is immersed in the etching bath for about 60 sec+/−5 sec, so that approximately 0.18 μm of gold is etched from the surface. Since the dimensions of the gold contact are about 5 μm is length or width, this fraction does not substantially change the overall dimensions of the gold contact electrode. However, the etchant appears to attack each gold grain at a different rate, depending on its crystallographic orientation. As a result, the gold surface is given additional topography, corresponding to the different crystallographic orientations of the crystal grains. As the etchant etches the crystal grains differentially, it leaves a corrugated morphology on the gold surface, wherein some of the grains of the gold are recessed with respect to other grains by at least about 0.05 μm. This may result in a surface morphology characterized by a roughness wavelength of about 0.25 μm and an amplitude of at least about 0.05 μm.

The gold etchant may also remove any impurities or contaminants which may have become lodged on the surface of the contact electrode which may also improve the contact resistance of the contact electrode material. Importantly, the etching, rinsing and drying steps S600-S800 may be performed directly before the device is encapsulated in the lid wafer in step S900. Therefore, the etching may be the last physical or chemical manipulation performed on the before enclosure. In this way, the contact electrodes are as essentially as clean as possible before enclosure in the cavity.

Figure 6:
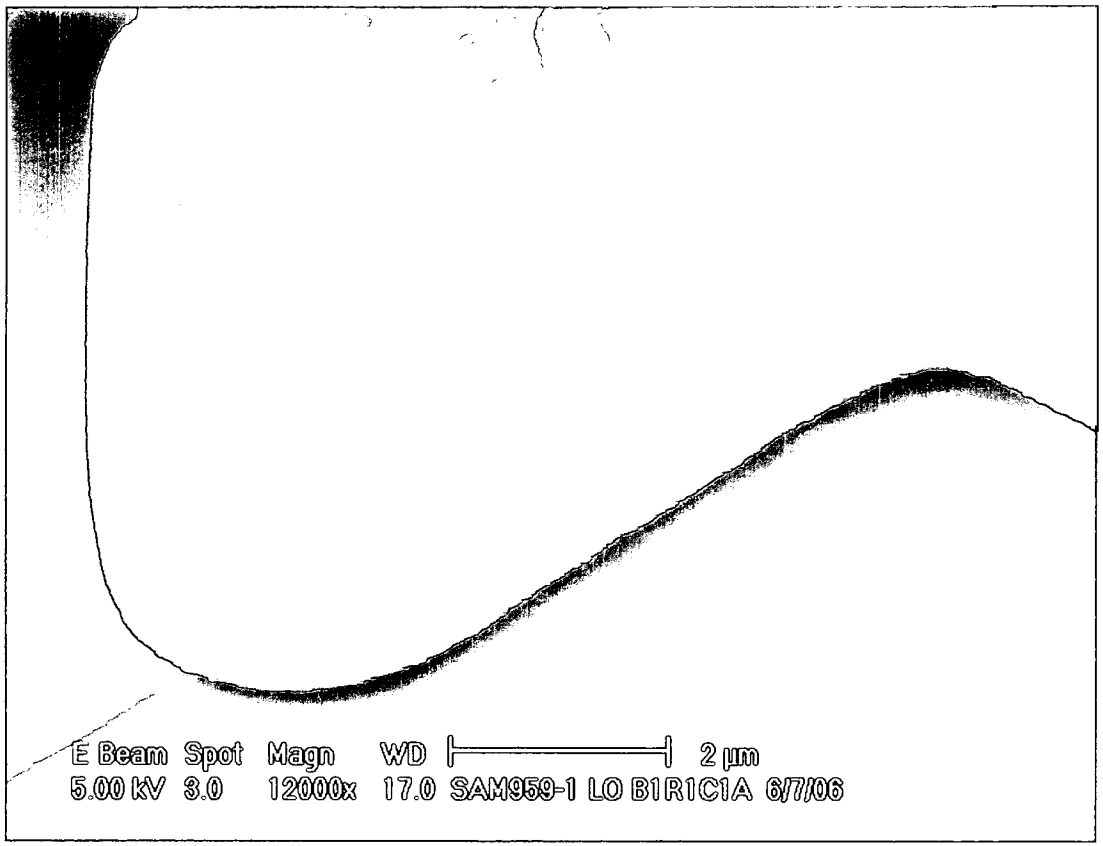
FIG. 6 is a scanning electron microscope image of the contact electrode as produced without the etching method.
Figure 7:
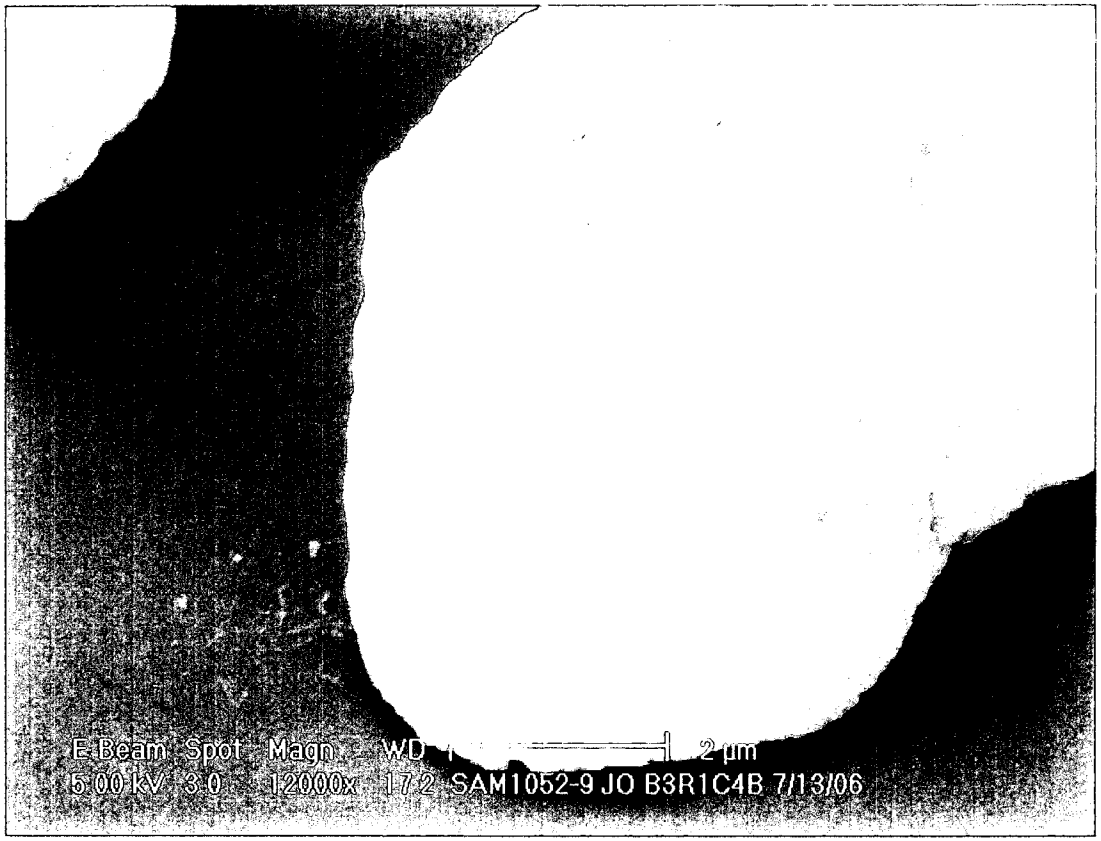
FIG. 7 is a scanning electron microscope image of the contact electrode after the etching method is performed.

The change in the surface morphology of the contact electrodes is illustrated in FIGS. 6 and 7. FIG. 6 is a scanning electron micrograph (SEM) of the surface of the unetched gold contact electrode. As seen in FIG. 6, the surface morphology is corrugated on a fine scale, with the surface features imprinted on the surface by the photoresist stencil that was used to plate the gold contact electrodes. In contrast, FIG. 7 shows the condition of the gold electrode after the etching process illustrated in FIG. 5. As can be seen in FIG. 7, the etching process leaves a surface with larger apparent corrugations, which may be the corrugations of the gold grains with different crystallographic orientations recessed from one another. A characteristic dimension of the gold grains is about 0.5 μm, although grains of varying size may be seen in the image. The depth of the corrugation between the grains has been measured to be on the order of about 0.05 μm, as shown more clearly in FIG. 8. The corrugation may result from the action of the etching, wherein the etch rates of the different grains depends on the crystallographic orientation of the grains. This corrugation may have a characteristic wavelength of about 0.25 μm, and an amplitude of at least about 0.05 μm, resulting from the etching treatment. Because of the corrugation, the contact plane, shown in FIG. 8, defined by the outer edges of the protruding grains of the contact surface, is a clean, pure gold material. Accordingly, along the contact surface, an outer edge of at least one grain is recessed with respect to adjacent grains, and recessed with respect to the contact plane by at least about 0.05 μm. Furthermore, mating two similarly etched contact surfaces may result in the enmeshing of the corrugation features, thereby increasing the overall contact area and reducing the contact resistance. When mated therefore, these contact surfaces may form adjunction with exceedingly low contact resistance.

Figure 8:
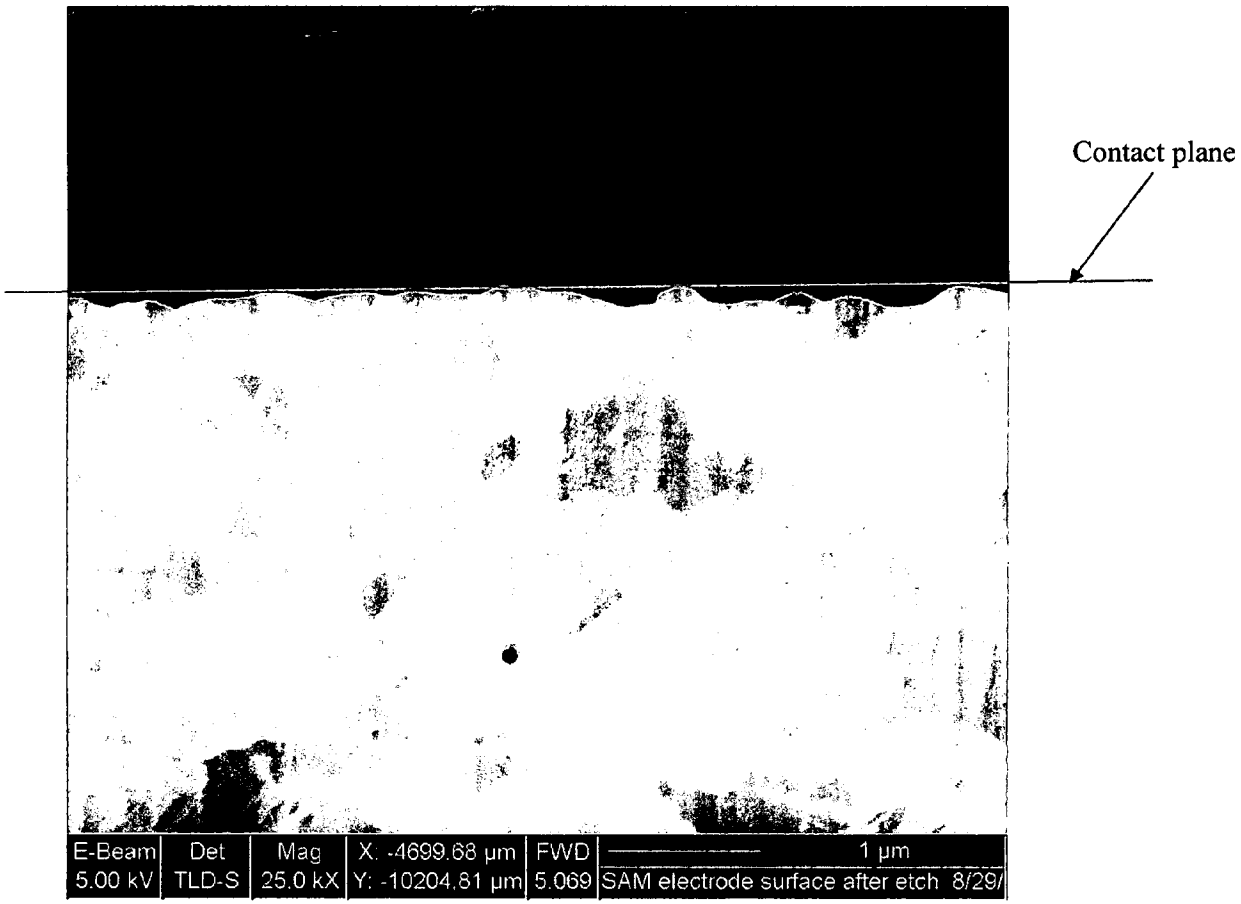
FIG. 8 is a cross sectional scanning electron microscope image of the contact electrode after the etching method is performed.

FIG. 8 is a scanning electron micrograph (SEM) cross sectional image of the contact electrode after the etching treatment has removed about 0.18 μm of material from the electrode surface. The SEM cross section clearly shows the distinct gold grains making up the contact electrode surface. Again, the characteristic dimension of the gold grains is about 0.5 μm in this figure. The outer edges of the gold grains define a contact plane which will contact an opposing contact electrode, as shown in FIG. 8. The gold grains of the contact surface are separated by recessed areas which are at least about 0.05 μm deep with respect to the contact plane.

Figure 9:
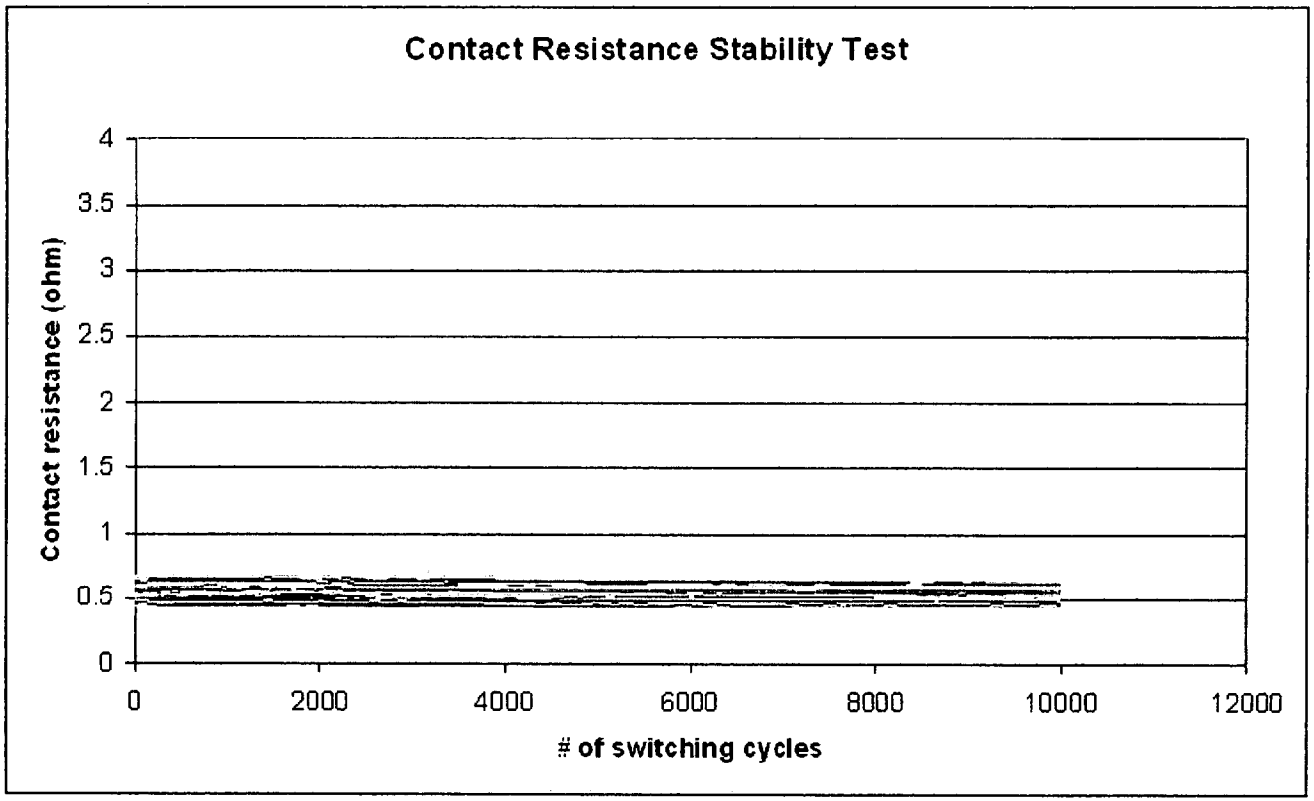
FIG. 9 is a plot of the contact resistance versus number of cycles for the contact electrode after the etching method has been performed.

FIG. 9 is a plot of the contact resistance between contact electrode 170 and contact electrode 270 as a function of the number of open/closing cycles, after performing the etch process illustrated in FIG. 5. The data plotted in FIG. 9 show the contact resistance for a population of MEMS switches such as that shown in FIG. 3. As can be seen in the plot, the contact resistance is quite consistently under 1 ohm for the different switches in the population. Even for a particular switch, the contact resistance does not rise appreciably even out to about 10000 cycles. This behavior is qualitatively different than that displayed in FIG. 3, and is attributed to the etching process performed on the contact electrodes.

These results may in no way be peculiar to gold, and the methods may be applied to any metal material which forms grains of different crystallographic orientations which can be etched at different rates from the surface of the metal material. For example, the metal materials which may make use of this etch process may include nickel, aluminum, silver, chromium, copper, cadmium, iron, ruthenium, rhodium, and alloys of gold such as gold palladium and gold tungsten.

Figure 10:
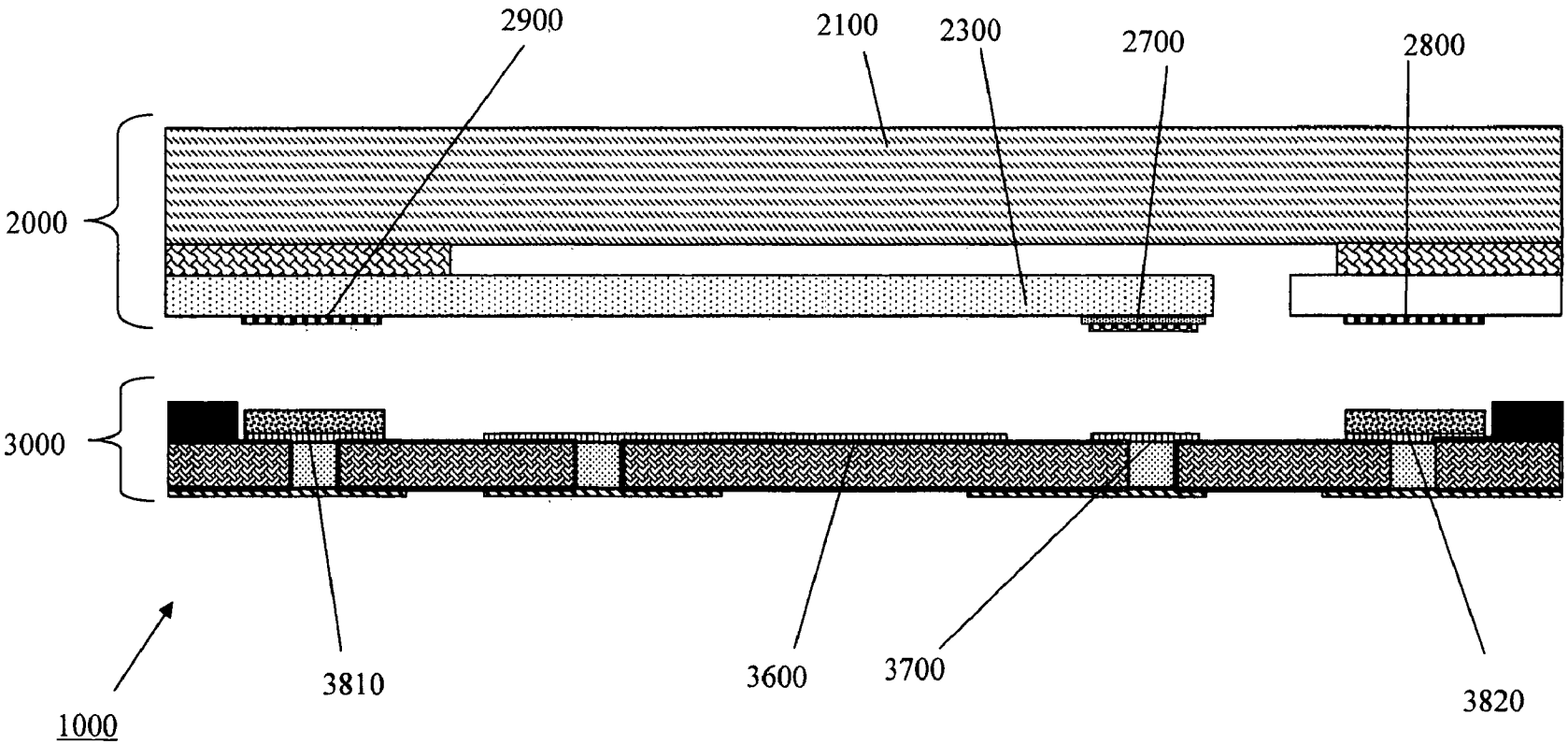
FIG. 10 is a cross sectional view of a second exemplary MEMS switch platform suitable for the application of the etching systems and methods.

FIG. 10 shows a second exemplary embodiment of a switch using contact electrodes formed by the systems and methods disclosed here. The second exemplary embodiment is also an electrical switch, but of a different type than the first exemplary embodiment illustrated in FIG. 1. The second exemplary embodiment is a cantilevered electrostatic switch 1000, which is formed on two substrates 2000 and 3000. In this embodiment, the moving cantilevered beam 2300 and shunt bar 2700 are formed on a first, upper substrate 2000, and the electrostatic drive plate 3600 and input and output electrode terminals 3700 are formed on a second, lower substrate 3000. In contrast to the first exemplary embodiment, the contact surfaces of the contact electrodes 3700 of the second exemplary embodiment are oriented parallel to, rather than perpendicular to, the substrate surfaces. For ease of depiction, only one of the electrodes 3700 is shown in FIG. 10, however it should be understood that a second similar electrode is located directly behind that shown in FIG. 10. The first substrate 2000 and the second substrate 3000 are subsequently bonded together using, for example, a gold/indium alloy seal 3810 and 3820. Further details as to the fabrication of the dual substrate switch 1000 may be found in U.S. patent application Ser. No. 11/211,623, incorporated by reference herein in its entirety. No additional lid wafer may be required in this embodiment, as the first, upper substrate may form a lid for the second, lower substrate. The first, upper substrate may be bonded to the second, lower substrate using the same or similar bonding technology as used for the first exemplary embodiment, and described more fully in the incorporated '622 patent application.

The contact electrodes in dual substrate switch 1000 are the shunt bar 2700 on the cantilevered beam 2300, which is suspended above the contact electrodes 3700 located on the lower substrate 3000. When the electrostatic drive plate 3600 is energized, it pulls the cantilevered beam 2300 downward until the shunt bar 2700 makes contact with the two lower contact electrodes 3700. The shunt bar 2700 lies across and connects these electrodes electrically, closing the switch. Accordingly, it is the contact resistance of these two surfaces, that of the shunt bar 2700 and contact electrodes 3700, which determines the contact resistance of the switch, and therefore the resistive signal loss across the switch terminals.

The shunt bar 2700 may be formed on the surface of the cantilever beam 2300 by a lift off process more fully described in the incorporated '623 patent application. The shunt bar 2700 may actually be a multilayer comprising first a thin layer of chromium (Cr) for adhesion to the silicon and silicon dioxide surfaces. The Cr layer may be from about 50 Angstroms to about 100 Angstroms in thickness. The Cr layer may be followed by a 100 Angstrom thick layer of molybdenum (Mo), and finally a thicker layer between about 3000 Angstroms to about 1 μM of gold (Au) as the conductive metallization layer. The purpose of the Mo layer is to be a diffusion-barrier between the Cr and the Au, preventing the diffusion of Cr into the Au, which would otherwise dramatically increase the resistance of the Au.

The electrostatic drive plate 3600 and contact electrodes 3700 may be formed on the second, lower substrate 3000 using the same multilayer as was used for the shunt bar 2700 on the first, upper substrate 2000 for the cantilevered beam portion of the dual substrate electrostatic MEMS switch 1000. The metallization multilayer may have similar thicknesses and may be formed using a similar process as that used to form the shunt bar 2700 on the first, upper substrate 2000. This metallization layer may also serve as a seed layer for the deposition of indium for the formation of the alloy seal, as described further in the '623 patent application.

Although the metallization layer may consist of a thin adhesion layer of Cr, and an antidiffusion layer of Mo, followed by a relatively thick layer of Au, it should be understood that this embodiment is exemplary only, and that any material having acceptable electrical transport characteristics may be used as metallization layer of electrostatic drive plate 3600 and contact electrodes 3700. In particular, additional exotic materials may be deposited over the gold such as ruthenium, to achieve particular contact properties, such as low contact resistance and improved wear.

Each of the Cr, Mo and Au layers may be sputter deposited using, for example, an ion beam deposition chamber (IBD). In an IBD chamber, the three targets, Cr, Mo and Au may be rotated into position to deposit the multilayer films without breaking the vacuum. The multilayer may be deposited in the region corresponding to the shunt bar 2700, and also the bond line areas 2800 and 2900 which will form the bond line between the first, upper substrate 2000 and the second, lower substrate 3000 of the dual substrate electrostatic MEMS switch 1000. In areas where the multilayer film is to be removed, it may be deposited over a layer of patterned photoresist, which is subsequently removed using, for example, ultrasonic agitation to loosen the photoresist from the substrate surface. This leaves the multilayer metallization film only in areas 2700, 2800 and 2900 to form the shunt bar and bond line areas, respectively.

The bond line areas 2800 and 2900 of metallization will form, with a layer of indium, an alloy seal which will hermetically seal the first, upper substrate 2000 with the second lower substrate 3000. Details regarding the formation of the shunt bar 2700 and bond line areas 2800 and 2900 and the alloy seal are more fully set forth in the incorporated '623 application.

The etching systems and methods may be applied to this switch in a fashion similar to the first embodiment shown in FIG. 1. The etching process may be performed on the first, upper substrate 2000 to etch the shunt bar 2700, as well as the second, lower substrate 3000 to etch the electrostatic drive plate 3600 and the contact electrodes 3700. After etching, rinsing and drying the substrates, they may be bonded together to form the electrostatic cantilevered switch 1000. Alternatively, the etching process may be performed after the substrates have been bonded with the bond line areas 2800 and 2900.

The etchant in this embodiment may be the same as in the previous embodiment, however, because the total thickness of the gold film is much thinner than the bulk plated gold of the first embodiment, the etching may be performed for a shorter period of time in order to remove a smaller amount of gold from the shunt bar 2700 and contact electrodes 3700. In this embodiment, a potassium iodide etchant such as GE-8111 may be used to etch the surfaces of gold shunt bar 2700 and gold contact electrodes 3700. However, in this embodiment, since the shunt bar 2700 and gold electrodes 3700 are thin films only about 0.5 μm thick to begin with, the etching is only performed for about 30 seconds before rinsing the shunt bar 2700 and contact electrodes 3700 in deionized water to stop the etching process. This removes a total of about 90 nm of gold from the surface of the shunt bar 2700 and contact electrodes 3700.

Alternatively, the gold film may be made somewhat thicker to budget for the removal of some of the gold material from the etching process. For example, if a final film thickness of about 0.5 microns is desired, an initial film thickness of about 0.7 μm may be deposited, and about 0.2 μm of the gold film may be removed during the etching, leaving the desired film thickness of about 0.5 μm. In this embodiment, the final etching step may be performed for about 60 seconds, rather than 30 seconds as set forth in the previous embodiment, to remove the extra 0.2 μm of material deposited in the thin film.

While a Cr/Mo/Au multilayer is disclosed as being usable for the metallization layer of the shunt bar 2700 and electrodes 3700 it should be understood that this multilayer is exemplary only, and that any other choice of conductive materials or multilayers having suitable electrical transport properties and which can be etched may be used in place of the Cr/Mo/Au multilayer disclosed here. For example, the conductive materials may include nickel, aluminum, silver, chromium, copper, cadmium, iron, ruthenium, rhodium, and alloys of gold such as gold-palladium and gold-tungsten.

In addition, exotic materials such as ruthenium (Ru) can be deposited on top of the Au to improve the switch contact properties, etc. For these other embodiments, an etchant may be chosen which is suitable for etching the exposed metal material of the contact surface. If ruthenium is chosen to cover the top of the gold electrode, for example, it may be etched with Ruthenium Etchant RU-44, also manufactured by Transene Corporation. RU-44 is a ceric ammonium nitrate/nitric acid etching solution for most types of deposited ruthenium films. The precise etch rate will depend upon the ruthenium density and process conditions. However, in general, at room temperature, the etch rates are usually similar to that of GE-8111 for gold, about 3 nm/sec.

Alternatively, the same or similar etch processes may be applied to gold alloys, wherein an additional element has been plated with the gold to increase its hardness, for example. In one embodiment, palladium (Pd) is plated with the gold, to form a gold-palladium contact alloy which may then be etched with the same or similar gold etchant as described above. This may provide a contact surface with improved tribological and wear characteristics, while maintaining outstanding contact resistance.

Furthermore, a switch may be manufactured having at least one contact electrode formed using the etch procedure, while other contact electrode may be formed from a different material with or without using the etch procedure. This may allow a hard contact, such as that made from ruthenium or a gold-palladium alloy, to mate with a softer contact material, such as gold. This may promote low contact resistance while avoiding contact adhesion which may result if both contacts are made from a soft material such as gold.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. While the embodiment described above relates to a microelectromechanical switch, it should be understood that the techniques and designs described above may be applied to any of a number of other devices, including integrated circuits with contact electrodes. While the systems and methods have been described with respect to a liquid etching process, it should be understood that a gaseous or isotropic plasma etch, or a sputter etch may also be used to obtain the desired surface morphology. Furthermore, details related to the specific etch times and dimensions for the contact electrodes are intended to be illustrative only, and the invention is not limited to such embodiments. Accordingly, the exemplary implementations set forth above, are intended to be illustrative, not limiting.

What is claimed is:

1. A contact electrode for a device supported on a substrate surface, comprising:

a corrugated contact surface having a plurality of metal grains whose outer edges define a contact plane, wherein the outer edge of at least one metal grain is recessed from the outer edges of adjacent metal grains and is recessed by at least about 0.05 μm with respect the contact plane, and wherein the corrugation is defined by adjacent grains of different crystallographic orientations, wherein the adjacent grains are separated by and share a grain boundary.

2. The contact electrode of claim 1, wherein the metal grains comprise at least one of gold, nickel, aluminum, silver, chromium, copper, cadmium, iron, ruthenium, rhodium, gold-palladium and gold tungsten, and wherein the outer edges of adjacent metal grains is recessed by at most 1 μm.

3. A micromechanical device comprising at least one contact electrode of claim 1.

4. The micromechanical device of claim 3, further comprising at least one cantilevered beam supported over the substrate surface and supporting the corrugated contact surface, which is oriented substantially parallel to the substrate surface.

5. The micromechanical device of claim 1, wherein the corrugated contact surface has a roughness characteristic wavelength of about 0.25 μm and a roughness amplitude of about 0.05 μm.

6. The micromechanical device of claim 5, wherein the cantilevered beam comprises at least one of single-crystal silicon, nickel and a nickel alloy.

7. The micromechanical device of claim 3, wherein the at least one contact electrode forms a part of an electrical switch, the switch having a contact resistance of less than 1 ohm.

8. The micromechanical device of claim 4, wherein the cantilevered beam is actuated by electrostatic forces between the cantilevered beam and an electrostatic drive plate supported on another substrate surface.

9. The micromechanical device of claim 8, wherein the at least one contact electrode is a multilayer structure, comprising:

a layer of chromium less than about 10 nm thick;

a layer of molybdenum about 10 nm thick; and a layer of gold between about 300 nm and about 1 μm thick.

10. The micromechanical device of claim 8, further comprising at least one additional electrode with a corrugated contact surface disposed on the another substrate surface, and wherein the cantilevered beam is electrostatically actuated to bring the contact surface supported by the cantilevered beam into electrical contact with the at least one additional electrode supported on the another substrate surface.

11. A method for making a device, comprising:

forming at least one contact electrode for the device supported by a substrate;

etching a corrugated contact surface on the at least one contact electrode, the corrugated contact surface having a plurality of metal grains whose outer edges define a contact plane, until the outer edge of at least one metal grain is recessed from the outer edges of adjacent metal grains, and is recessed by at least about 0.05 μm with respect to the contact plane and wherein the corrugation is defined by adjacent grains of different crystallographic orientations, wherein the adjacent grains are separated by and share a grain boundary.

12. The method of claim 11, wherein forming the at least one contact electrode further comprises:

plating a sacrificial layer over a surface of the substrate;

plating at least one gold contact electrode on the sacrificial layer; and plating a cantilevered beam on the sacrificial layer, and contiguous with the at least one gold contact electrode, wherein the contact surface of the at least one gold contact electrode is oriented substantially perpendicular to the substrate surface.

13. The method of claim 11, wherein the at least one contact electrode comprises gold, and etching the at least one contact electrode comprises etching the gold contact electrode in a solution comprising at least one of iodine and cyanide, for about 60 seconds.

14. The method of claim 11, further comprising:

rinsing the substrate in deionized water to remove the etchant and stop the etching of the at least one contact electrode; and drying the substrate to remove the deionized water and the etchant.

15. The method of claim 11, wherein etching the at least one contact electrode comprises at least one of etching the at least one contact electrode in a liquid etchant, etching the at least one contact electrode in a gaseous etchant, etching the at least one contact electrode in a plasma, and sputter-etching the at least one contact electrode.

16. The method of claim 11, wherein forming the at least one contact electrode on the substrate further comprises:

etching an outline of a cantilevered beam in a device layer of the silicon-on-insulator substrate;

forming the at least one contact electrode on an end of the cantilevered beam, such that the contact surface of the at least one contact electrode is substantially parallel to the cantilevered beam; and releasing the cantilevered beam by etching an insulating layer from the silicon-on-insulator substrate, in a region beneath the outline of the cantilevered beam.

17. The method of claim 11, wherein forming the at least one contact electrode comprises:

electroplating the at least one contact electrode over a sacrificial layer formed on a surface of the substrate; and electroplating a cantilevered beam supported over the sacrificial layer, and contiguous with the at least one contact electrode.

18. The method of claim 17, wherein the contact surface of the at least one contact electrode is disposed in a plane substantially perpendicular to the substrate surface.

19. The method of claim 11, further comprising:

forming a cavity in a lid wafer; and bonding the lid wafer to the substrate to form encapsulate the device in a protective cavity.

20. The method of claim 19, wherein the etching of the contact surface is at least one of a last physical and a last chemical manipulation of the contact surface before the lid wafer is bonded to the substrate to form the protective cavity for the device.

* * * * *